US005237709A

United States Patent [19]

Byerly et al.

[11] Patent Number: 5,237,709

[45] Date of Patent: Aug. 24, 1993

[54] APPARATUS FOR PROVIDING A CONTROLLED FLOW OF WASTE MATERIAL FROM A WASTE STORAGE TANK

[75] Inventors: Robert M. Byerly, Burbank; Thomas F. Johnson, Dana Point, both of Calif.

[73] Assignee: TA Mfg. Co., Glendale, Calif.

[21] Appl. No.: 864,053

[22] Filed: Apr. 6, 1992

Related U.S. Application Data

[63] Continuation of Ser. No. 354,387, May 19, 1989, abandoned.

[51] Int. Cl.[5] ..... E03D 1/00

[52] U.S. Cl. ..... 4/323; 220/259

[58] Field of Search ..... 4/321, 323; 137/384–388, 613, 800; 251/99; 220/259, 264, 326

[56] References Cited

U.S. PATENT DOCUMENTS

| | | | |
|---|---|---|---|
| 1,978,314 | 10/1934 | Lancaster | 220/259 X |
| 2,121,596 | 6/1938 | Hill | 220/314 |
| 2,132,432 | 10/1938 | Offutt | 220/259 |
| 2,165,640 | 7/1939 | Marx | 137/613 X |
| 2,574,836 | 11/1951 | Marcell | 220/259 |
| 3,045,861 | 7/1962 | Dieter et al. | 220/314 |
| 3,148,704 | 9/1964 | Blass | 251/99 X |
| 3,302,816 | 2/1967 | Sloper et al. | 220/259 |
| 4,098,427 | 7/1978 | Duckworth, Jr. | 220/259 |
| 4,114,203 | 9/1978 | Carolan | 4/323 X |
| 4,126,294 | 11/1978 | De Frees | 251/99 |
| 4,127,215 | 11/1978 | Morrison | 220/259 X |
| 4,690,296 | 9/1987 | Elliott | 220/259 |

*Primary Examiner*—Henry J. Recla
*Assistant Examiner*—Robert M. Fetsuga
*Attorney, Agent, or Firm*—Ellsworth R. Roston; Charles H. Schwartz

[57] ABSTRACT

A valve assembly provides for a controlled flow of waste material from a toilet in an aircraft under all weather conditions including freezing. The valve assembly includes a first valve disposed within a hollow tube and manually movable between a first position sealing the tube against the passage of waste material and a second position providing for such passage. The valve includes first and second members and a plate manually rotatable within the tube between the first and second positions, the second member and the plate receiving a multiplied force from a further rotation of the first member to pivot to a position sealing the valve to the tube. An energy storage member associated with the second member facilitates the pivotable movement of the second member. Detents in the tube and at the end of the second member retain the plate in sealing relationship with the tube. The valve assembly also includes a second valve mounted externally on the tube downstream from the first valve and manually rotatable between a first position sealing the tube and a second position opening the tube. The second valve includes a member for rotating, and then pivoting, the second member and the plate in the first valve from the second position to the sealed relationship with the tube when the second valve is rotated from the second position to the first position. The second valve includes a retainer in the tube and a mechanism on the valve for latching the second valve to the tube in the first position of the second valve.

20 Claims, 5 Drawing Sheets

APPARATUS FOR PROVIDING A CONTROLLED FLOW OF WASTE MATERIAL FROM A WASTE STORAGE TANK

This is a continuation of application Ser. No. 354,387, filed May 19, 1989, abandoned.

This invention relates to apparatus for providing a controlled drainage of waste material from a toilet in an airplane. More particularly, this invention relates to apparatus which is operable under all weather conditions including freezing for providing a controlled drainage of waste material from a toilet in an airplane.

While an airplane is flying through the atmosphere at elevated temperatures such as approximately forty thousand feet (40,000'), the temperature inside the airplane is quite pleasant for the convenience of the passengers. Therefore, the passengers are able to relieve themselves of waste material in a toilet whose visible parts are at the ambient temperature inside the airplane. These visible parts include the toilet and the toilet bowl and the valve for flushing the material in the toilet bowl. When the toilet bowl is flushed by the operation of the valve, the waste material in the bowl passes to a waste storage tank. The waste storage tank may be exposed to the atmosphere outside of the airplane. At elevations such as approximately forty thousand feet (40,000'), the temperature of the atmosphere may be considerably below freezing.

When the airplane lands, the waste storage tank is drained during ground service by the operation of accessible drain couplings attached on the aircraft to the waste storage tank. Such drain couplings generally have a protective end cap over an outer opening. The end cap is removable so that a drain hose from a ground service cart can be coupled to the outer opening in the end cap. In addition to the end cap, the drain couplings include a drain valve or plug which is opened after the drain hose is attached. Since the airplane has often been subjected to freezing temperatures in the air and may even be subject to freezing temperatures on the ground, it has not been easy to open the valves so that the waste material in the storage tank can be drained.

After the storage tank has been drained of waste material, the maintenance or service personnel decouples the drain hose, closes or replaces the drain valve or plug and replaces and repositions the end cap over the outer opening in the drain coupling. In practice, sometimes the ground servicing personnel make errors, such as forgetting or incompletely closing or replacing the drain valve or plug or improperly repositioning the end cap. Such incomplete closure or replacement of the drain valve or plug or improper repositioning of the end cap may result from ice on these parts, either from the recent flight of the airplane in the atmosphere or the parking of the airplane on the ground.

Under the conditions discussed in the previous paragraph, the incomplete closure or replacement of the drain valve or plug and the improper repositioning of the end cap may occur even if the service personnel is conscientious. If the airplane is thereafter flown under such circumstances, there can be an unsanitary and even dangerous leakage or loss of the waste material from the storage tank and malfunction of the toilet system in the airplane.

The problems discussed in the previous paragraphs have existed for some time. Knowledge of these problems has also existed for some time and these problems have been considered to be serious in the aircraft industry. Because of this, a considerable amount of energy, and a significant expenditure of money, have been devoted to resolving these problems. In spite of this effort and money expenditure, the problems still persist.

This invention provides apparatus which overcomes the problems discussed above. The invention includes a valve assembly which is operable to close a storage tank for waste materials under all weather conditions including freezing. The valve assembly is also operable under all weather conditions including freezing to provide for an easy opening of the coupling to the waste storage tank so that the waste material in the tank can be quickly and efficiently cleaned from the tank.

In one embodiment of the invention, a valve assembly provides for a controlled flow of waste material from a toilet in an aircraft under all weather conditions including freezing. The valve assembly includes a first valve disposed within a hollow tube and manually movable between a first position sealing the tube against the passage of waste material and a second position providing for such passage.

The first valve includes first and second members and a plate manually rotatable within the tube between the first and second positions, the second member and the plate receiving a multiplied force from a further rotation of the first member to pivot to a position sealing the valve to the tube. An energy member associated with the second member facilitates the pivotable movement of the second member. Detents in the tube and at the end of the second member retain the plate in sealing relationship with the tube.

The valve assembly also includes a second valve mounted externally on the tube downstream from the first valve and manually rotatable between a first position sealing the tube and a second position opening the tube. The second valve includes a member for rotating, and then pivoting, the second member and the plate in the first valve from the second position to the sealed relationship with the tube when the second valve is rotated from the second position to the first position. The second valve includes a retainer in the tube and a mechanism on the valve for latching the second valve to the tube in the first position of the second valve.

As will be seen, the first and second valves operate on a redundant basis to assure the proper opening or closing of the coupling to the waste storage tank. -Furthermore, an additional safety factor is provided by disposing the first valve inside the drainage coupling and the second valve externally of the drainage coupling and by closing the second valve after the closing of the first valve. This safety factor is enhanced by providing for the closure of the first (or internal) valve by the closure of the external valve in case the first (or internal) valve has not been previously closed. This is effective in insuring the closure of the waste storage tank even if the service personnel has unintentionally failed to close the first valve or is unable to close the first valve because of ice. However, each of the first and second valves is constructed to provide for effective closure or opening even if such closure or opening is hampered by icy conditions.

DETAILED DESCRIPTION

Figure 1:
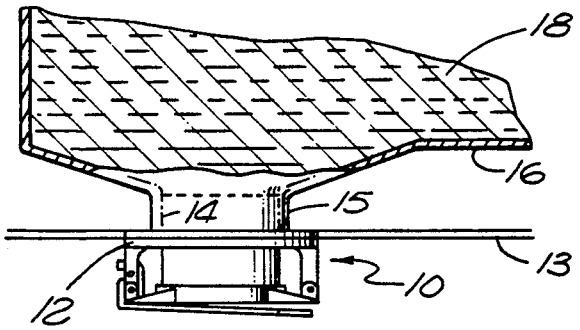
FIG. 1 is a fragmentary simplified elevational view showing an attachment to a waste storage tank in an aircraft of a drain coupling assembly constituting one embodiment of this invention.
Figure 2:
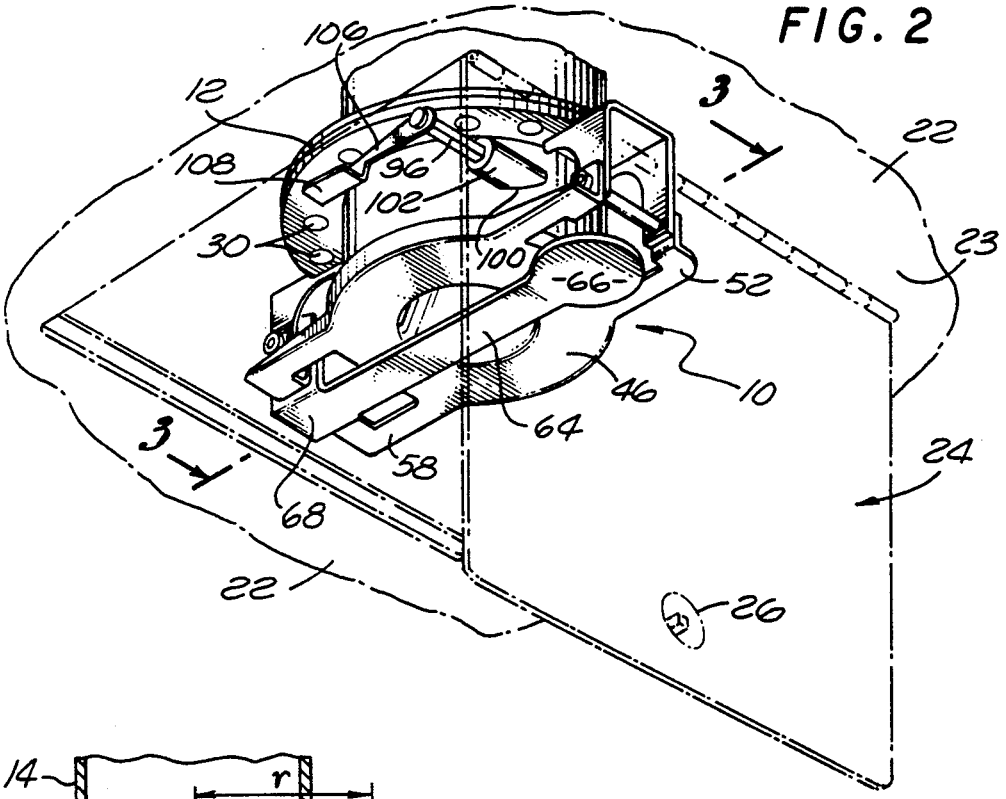
FIG. 2 is a perspective view from a position below the waste storage tank, as may be seen by aircraft service personnel, of the drain coupling assembly when installed in an aircraft toilet system and an access panel in the plane body is open but a drain endcap and a drain valve in the assembly are still closed.
Figure 3:
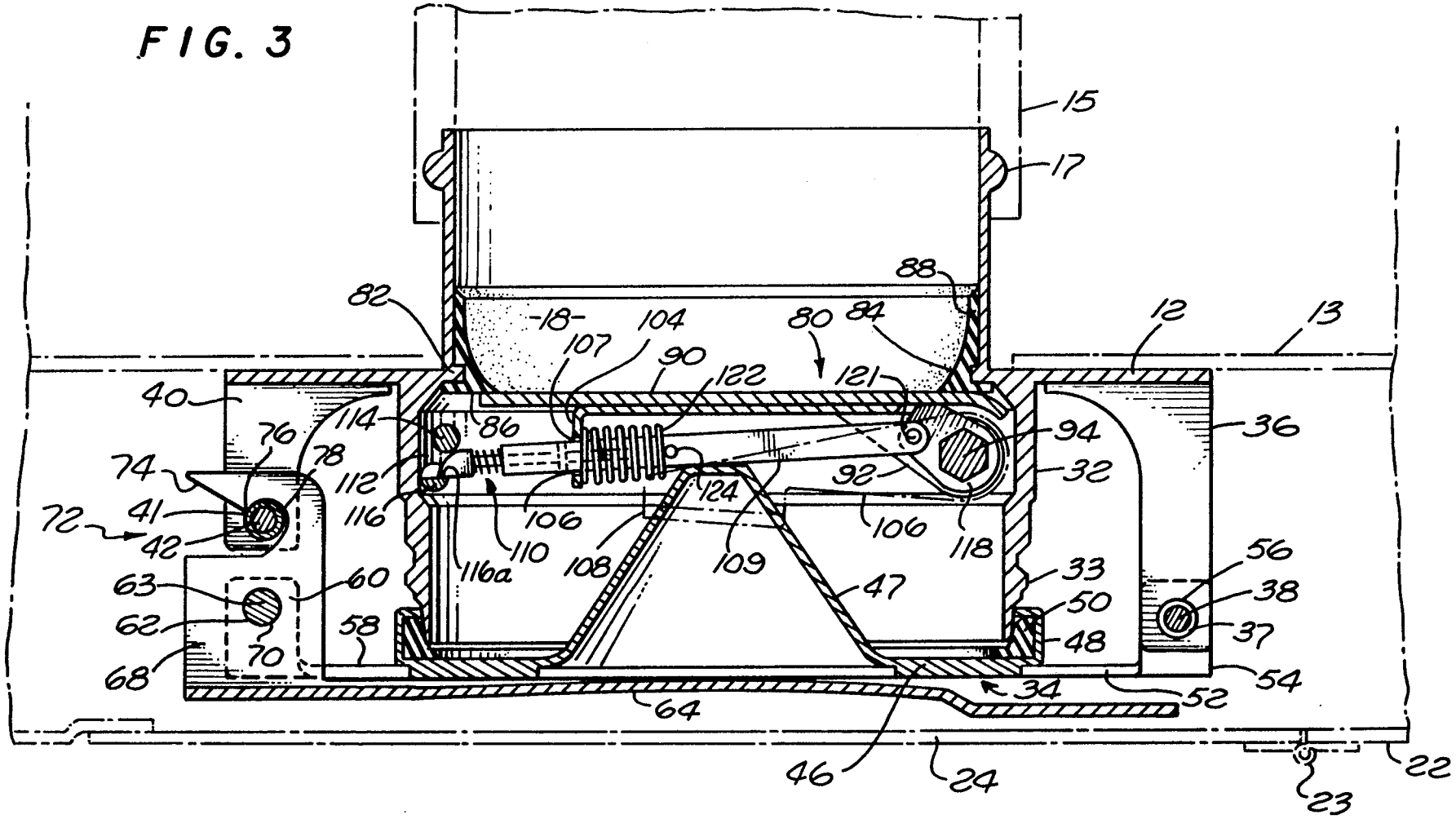
FIG. 3 is an enlarged cross sectional view in elevation, taken substantially on the line 3—3 of FIG. 2, of the capped and closed drain coupling assembly of FIG. 2, but with the access panel in the closed position.

FIG. 1 shows a drain coupling assembly generally indicated at 10, the parts of the assembly being generally made of a suitable durable metal such as stainless steel. The assembly 10 has a flange 12 attaching it to a portion of an aircraft structure 13. An upper cylindrical pipe or tube portion 14 of the assembly 10 is coupled to a drainpipe 15 of an aircraft toilet storage tank 16 constructed to retain waste 18. For example, a typical dimension for the tube portion 14 would be about four inches (4") in diameter, though the invention can be adapted for any suitable diameter. FIGS. 2 and 3 show how the drain coupling assembly appears when first viewed by ground service people after an access panel 24 in an outer plane body or faring 22 has been opened about a hinge 23 by releasing an access lock 26 (FIG. 2).

The upper cylindrical tube portion 14 has an annular raised portion or nipple 17 (FIG. 3) to facilitate coupling to the tank's drainpipe 15. The drain coupling assembly 10 also has a lower cylindrical pipe or tube 32 formed to facilitate a hose coupling, such as by having an annular raised portion or nipple 33.

The flange 12 has flange holes 30 (FIG. 2) to enable the flange to be bolted to the aircraft structure 13. To enable rotatable closure of the tube 32 by an endcap generally indicated at 34, a large, downward-projecting U-shaped bracket 36 (FIG. 3) is formed on the right side of the flange 12. The large bracket 36 has two hinge holes 37 at each lower end of the U-shaped portion through which is mounted an endcap hinge pin 38 retained in place by endnuts or the like. To enable attachment of an endcap latch, a smaller downward-projecting U-shaped bracket 40 (FIG. 3) is formed on the left side of the flange 12. The small bracket 40 has two hinge holes 41 at each lower end of a U-shaped portion through which is mounted an endcap latch pin 42.

The endcap 34 has a circular central cap portion 46 (FIGS. 3 and 6) formed with an upwardly-extending projection or cone 47 used for valve closing in a manner to be described below. At the rim of the central cap portion 46 is a U-shaped annular flange 48 adapted to accommodate a resilient O-ring or annular gasket 50. The annular gasket 50 is adapted to seal the endcap 34 to the bottom opening of the tube 32 when the gasket is pressed against the tube.

Extending from the right end of central cap portion 46 are two parallel arm portions 52, (FIGS. 2 and 3), each formed with an upward-extending tab 54 (FIG. 3) that has a hinge hole 56 in it to accommodate the endcap hinge pin 38. Thus, the central cap portion 46 is rotatably attached on the right about the hinge pin 38 in the large bracket 36 of the flange 12. Extending from the left end of the the central cap portion 46 are two parallel arm portions 58 (FIGS. 2 and 3), each formed with an upward-extending tab 60 has a hinge hole 62 in it to accommodate a handle hinge pin 63 retained in place by endnuts or the like.

During ground servicing, the endcap 34 is opened and closed by a handle lever 64 (FIGS. 2 and 3). The handle lever 64 is provided with a flat circular grip 66 at its free (right) end and is hingedly connected about the handle hinge pin 63 of the endcap 34 by an upward-projecting U-shaped bracket portion 68 at its other end, via hinge holes 70.

On the upward ends of the U-shaped portion of the bracket 68, above the hinge holes 70, are a parallel pair of latch recesses generally indicated at 72. The latch recesses 72 used to engage and disengage the right end of the endcap 34 from the latch pin 42 on the bracket 40. Each latch recess 72 has a latch cam surface defined by a cam ramp 74, a ramp peak 76, and a hinge-retaining hook 78. As shown in FIG. 3, when the endcap 34 is closed, it is secured against the bottom edge of the lower tube 32 by the hooking action of the hinge-retaining hook 78 around the endcap latch pin 42.

However, if the service person simply pulls down on the grip 66 of the handle lever 64, the left end of the endcap 34 will be smoothly released. This is because the handle lever 64 will rotate about the handle hinge pin 63, causing the ramp peak 76 of the latch cam surface 73 to ride up slightly over the latch pin 42 until the cam ramp 74 begins to engage and slide by the pin 42. This will "unhook" each latch recess 72 from the pin 42, releasing the left end of the endcap 34 so that it rotates downwardly about the endcap hinge pin 38 as a fulcrum. The partially released position of the endcap 34 is shown in FIG. 6 and the released position of the endcap 34 is shown in FIG. 5.

Figure 5:
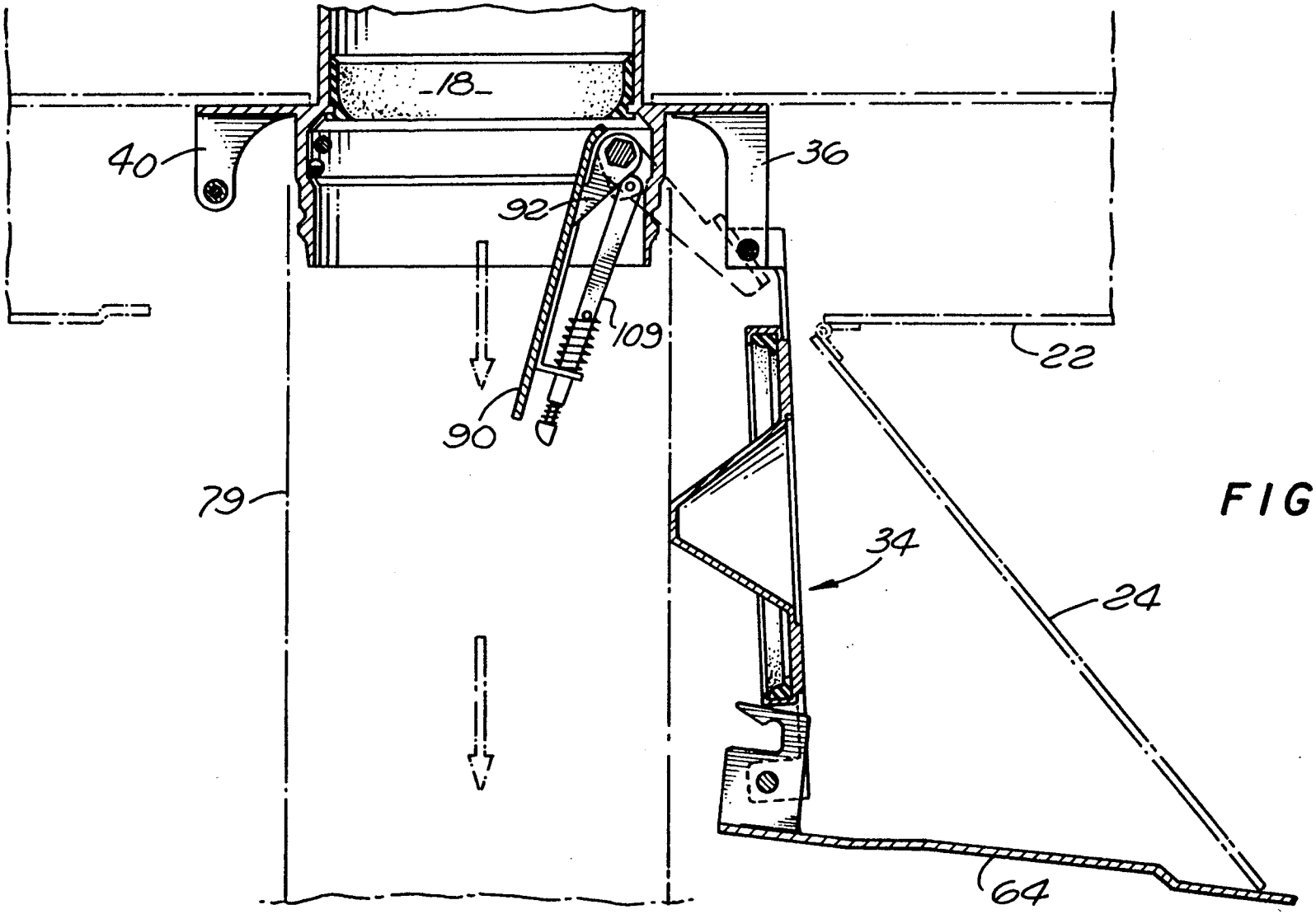
FIG. 5 is a cross sectional elevational view similar to that shown in FIGS. 3 and 4 and shows the drain coupling assembly of FIGS. 2–4 with (a) the access panel opened and drain endcap opened and hanging down and a drain hose attached and (b) the valve lock released and valve plate fully opened to enable waste fluid to flow downwardly through the hose from the waste storage tank.
Figure 6:
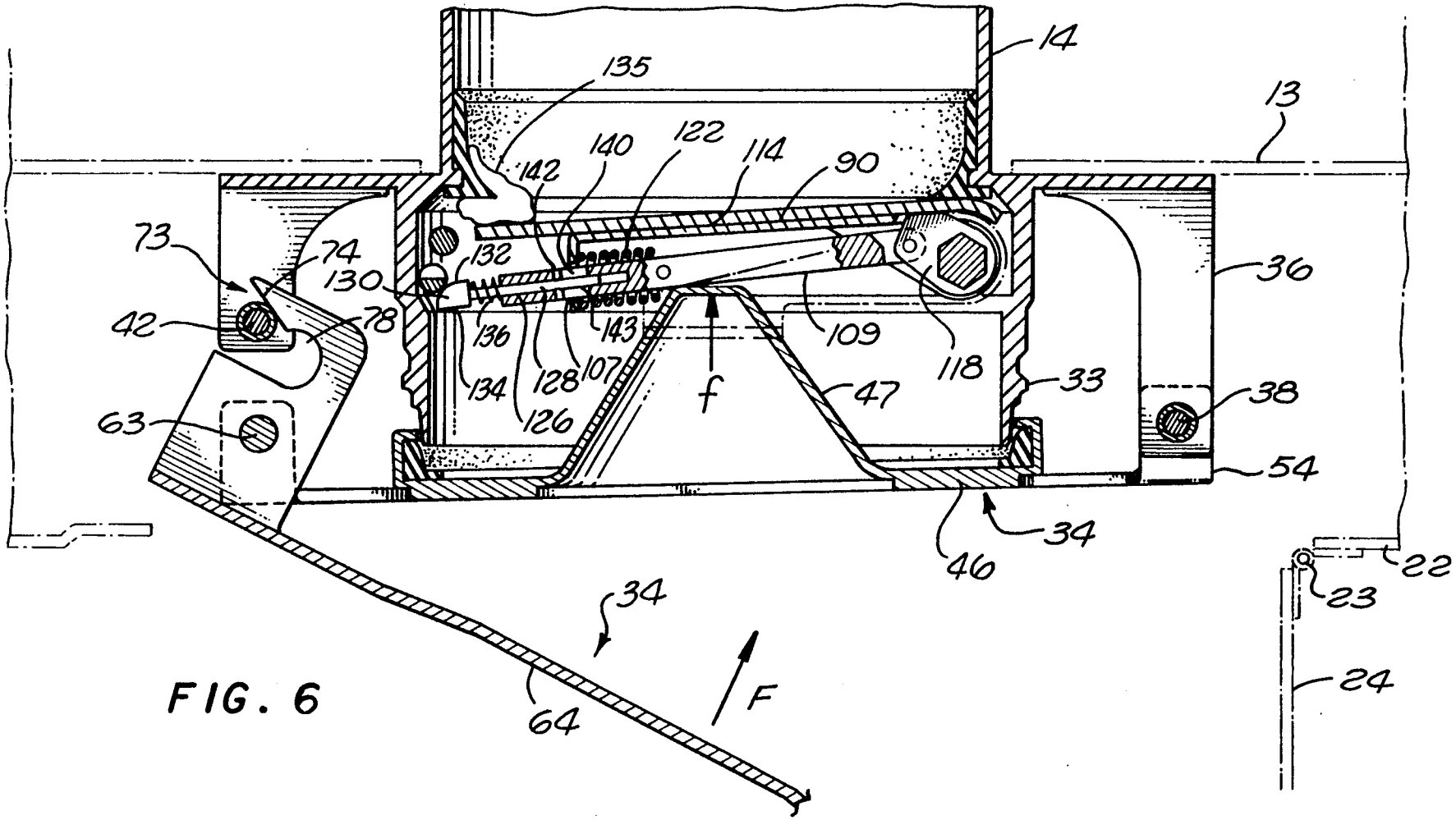
FIG. 6 is a cross sectional elevational view similar to that shown in FIGS. 2–5 and shows the coupling assembly of FIGS. 2–5 during the simultaneous closure, by means of a handle lever, of the valve plate and the drain endcap associated with the drain endcap when blocking matter, such as ice, has made closure of the valve plate by the valve lock lever ineffective.

As shown in FIG. 5, it is a feature of the invention that the downwardly hanging open endcap 34 is conspicuous. Furthermore, the downwardly-hanging open endcap 34 blocks closure of the access panel 22. This makes it unlikely that the endcap 34 will be overlooked when open or ignored by ground service personnel when such personnel complete the draining of the toilet system and thereafter decouple a drain hose 79. Furthermore, since the endcap 34 is attached by the hinge pin 38, it cannot become lost, and it cannot be discarded by negligent or disgruntled ground personnel.

Removing the endcap 34 allows the drain hose 79 to be connected, after which the next step is to open an inner valve generally indicated at 80, which is closed in FIG. 3. To form the seal of the inner valve 80, an annular projection 82 protrudes inwardly from the inner wall of the upper tube portion 14 to engage a resilient sealing grommet 84 that has a sealing face 86 and a wall-contacting extension 88. The sealing face 86 engages a rotatably mounted valve disk plate or flap 90.

To be rotatable, the valve plate 90 has attached to it at the right two parallel orthogonal projections 92 pierced by concentric hinge holes 94. The wall of the lower cylindrical pipe or tube 32 is also traversed at its right by two concentric hinge holes 100 (FIG. 2), and these holes are extended on the front and back sides of the tube 32 by cylindrical hinge tube portions 102. The hinge holes 94 on the-projections 92 are aligned with the hinge holes 100 and the tube portions 102 (FIG. 2) in the tube 32 and the holes 94 and 100 and the tube portions 102 are of similar radius. A shaft 96 (FIGS. 2 and 4) of a hexagonal cross section passes through the holes 94 and 100 and the tube portions 102. The hexagonal shaft 96 is retained in place by endnuts or the like at each end. At the front end of the shaft 96, a valve handle 106 (FIGS. 2 and 4) with a grip tab 108 is attached so that turning the valve handle 106 rotates the hexagonal shaft 96.

At the left end, the valve plate 90 has attached to it a single orthogonal projection 104 (FIGS. 3 and 4) with a leftward-facing hole 107 through which passes a valve lock bolt 109 having a spring-biased bolt head 110. The bolt head 110 engages a lock catch 112 formed by upper and lower cylindrical rods 114 and 116, the latter being notched with a flat catch surface 116*a*. A bias spring 122 surrounds the bolt 109 and is trapped in compression between the left projection 104 and a spring stop pin 124 passing transversely through the bolt 109 at an intermediate position along its length. The effect of the spring 122 is to bias the bolt 109 towards the right.

At its right end, the valve lock bolt 109 has a yoke which is rotatably linked by a pin 121 to a driving arm 118. The arm 118 has a hexagonal hole that nonrotatably engages the hexagonal shaft 96. To open the inner valve 80, the service person pulls the valve handle 106 downwardly (counterclockwise in FIGS. 2 and 3). This turns the hexagonal shaft 96 counterclockwise and pivots the driving arm 118 until it retracts the valve lock bolt 109 to about the position shown in FIG. 4. The bolt head 110 is then no longer in the lock catch 112. Further pivotal movement of the valve handle 106 in the counterclockwise direction beyond this point causes the valve lock bolt 109 to jam in the hole 107 (there is a small hole tolerance) so that the rotation of the handle 106 rotates the valve plate 90 downwardly, opening the inner valve. This permits the waste fluid 18 to drain through the toilet drain coupling 10 and the hose 79.

Before explaining how the valve can be closed, the structure of the spring-biased bolt will be described. The left end of the valve lock bolt 109 (FIG. 6) is formed with a tubular hole to slidably accommodate a cylindrical shaft 128, at the left free end of which is a latch head 130. The latch head 130 has a cylindrical upper cam surface and a flat catch lower surface. A bias spring 136 surrounds the shaft 128 and is trapped in compression between the latch head 130 and the left end of the bolt 109. The effect of the spring 136 is to bias the shaft 128 towards the left to move the latch head 130 into engagement with the catch 112 defined by the rods 114 and 116. The travel of the shaft 128, and hence the latch head 130, is limited by a stop pin 142 passing transversely through the shaft 128 near its left end and a longitudinally extending travel slot 143 formed in the lock bolt 109.

Figure 4:
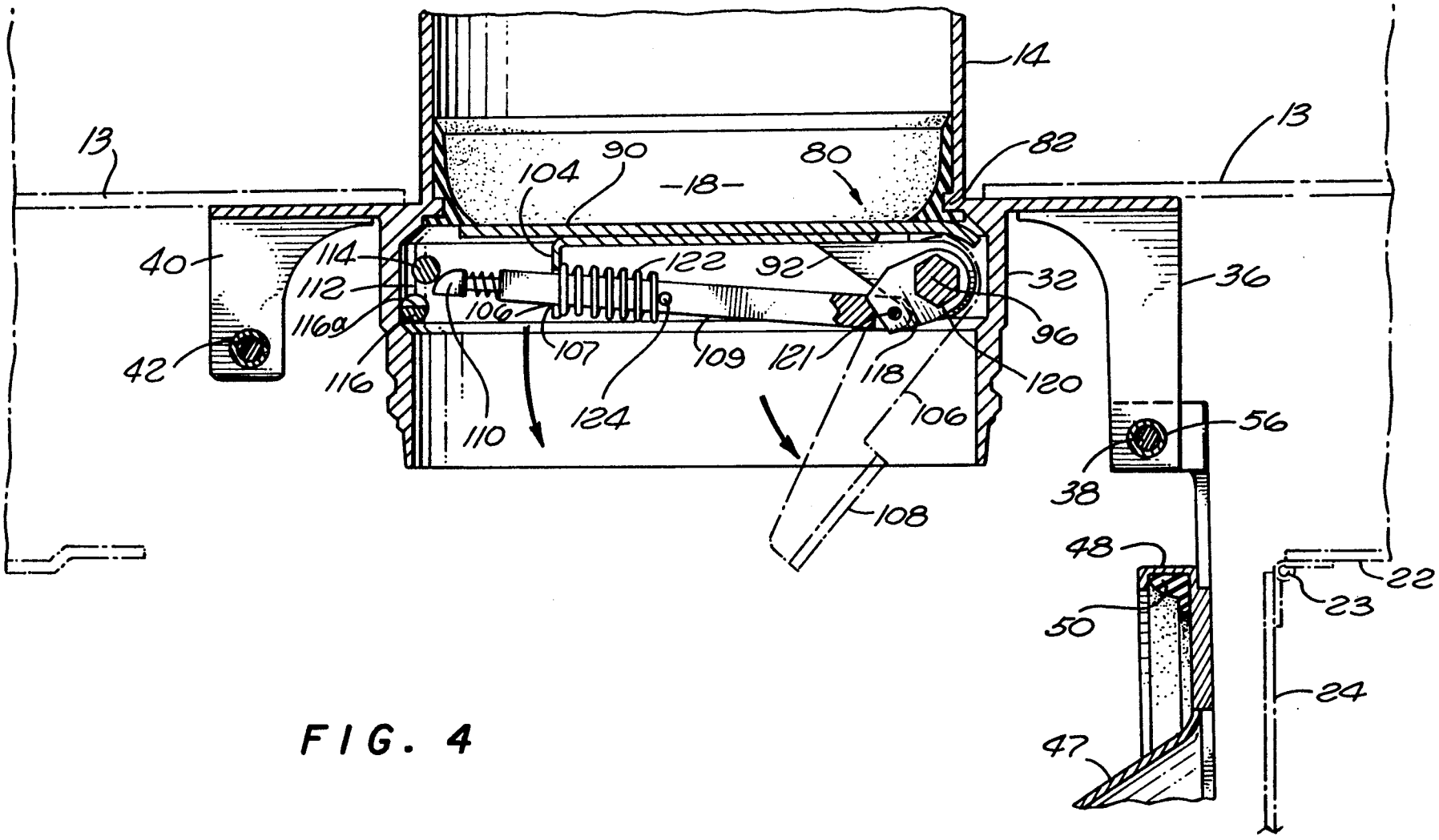
FIG. 4 is a cross sectional elevational view similar to that shown in FIG. 3 but shows the drain coupling assembly of FIGS. 2 and 3 with (a) the access panel in the open position and the drain endcap opened and hanging down and (b) a valve lock lever pushed down partially to release a valve lock without a valve plate being opened.

When the aircraft storage tank 16 has been drained, the service person removes the hose 79 (FIG. 5) and pushes valve handle 106 upwardly (clockwise motion in FIGS. 3 and 4). This turns the hexagonal shaft 96 clockwise and rotates the driving arm 118, the lock bolt 109, and the valve plate 90 until the valve plate meets some resistance, such as by contact with the seal grommet 84. Further rotation of the valve handle 106 (FIG. 3 and 4) beyond this point causes the valve lock bolt 109 to be pushed leftward in the hole 107 as the driving arm 118 turns relative to the valve plate 90. If the angle of the lock bolt 109 is right, the flat catch surface 134 enters the lock catch 112, sliding against the flat catch surface 116*a* as shown in FIG. 3.

It may sometimes happen that the angle of the lock bolt 109 is not sufficient for the flat catch surface 134 to slide against the flat catch surface 116*a*, in which case the spring bolt head 110 does not enter the catch 112. This may result from an ice formation 135 on the resilient grommet 84 as shown in FIG. 6. When ice blocks closure of the inner valve defined by the plate 90, the grommet 84 and the tube 14, the cylindrical upper cam surface 132 (FIG. 6) of the spring biased bolt head 110 simply rides on the lower cylindrical surface of the lower cylindrical rod 116. The valve handle 106 is in the "closed" position, but the inner valve 80 is not closed.

As shown in FIG. 6, it is still possible for service personnel to close the endcap 34 even when ice blocks such closure. Using the handle lever 64 (FIG. 6), the endcap 34 is pushed upwardly to engage cam ramp 74 on the endcap hinge pin 42. When the lever 64 is pushed further upwardly, the hinge pin 42 rides the cam ramp 74 over the ramp peak 76 and becomes "hooked" in the hinge-retaining hook 78. The upward-extending projection or cone 47 on the endcap 34 is dimensioned so that, when the endcap 34 is closed by pushing on the lever 64, the top of the cone 47 pushes against the valve lock bolt 109, causing the spring biased bolt head 110 to retract sufficiently to pop into the lock catch 112.

Figure 7:
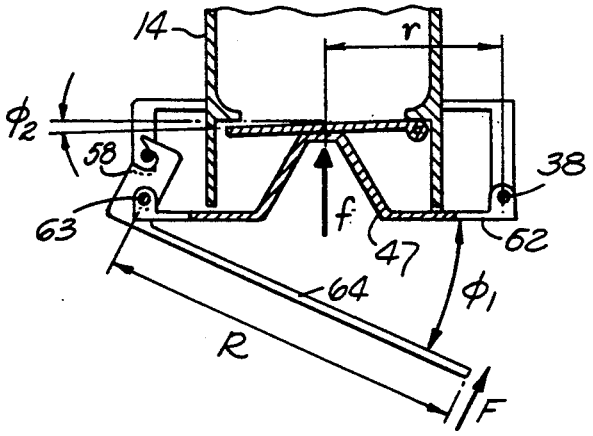
FIG. 7 is a simplified schematic elevational diagram, as seen from a position similar to that shown in FIGS. 2–6, illustrating how the valve plate and the end plate are closed by the operation of the handle lever associated with the drain endcap when blocking matter, such as ice, has made closure of the valve plate by the valve lock lever ineffective.

FIG. 7 shows that a lever action is instrumental in causing the force f applied by the center of the cone 47 to be many times greater than that applied at the end of the handle lever 64. This can be estimated by equating the work performed on the lever 64 to the work performed by the cone 47. For example, suppose a force F is applied to the lever 64 which has a lever arm R to rotate it through a relatively large angle $\phi 1$. Then the work performed by the service person is approximately $W = F \times R \times \phi 1$. Now suppose that this causes the cone 47 to apply a force f over a shorter lever arm r, rotating through a relatively small angle $\phi 2$. Since the work performed in each case is the same, the ratio of forces will be:

$$f/F = (R \times \phi 1)/(r \times \phi 2)$$

For example, taking conservative ratios of $R/r = 2$ and $\phi 1/\phi 2 = 10$, the ratio $f/F = 20$. While the actual amounts will, of course, vary according to the dimensions selected and the exact shape of the latch cam 73, it is clear that there is a multiplier effect that facilitates crushing of any blocking ice, etc. so that the inner valve defined by the tube 14, the grommet 84 and the plate 90 can be closed.

The apparatus described above has certain important advantages. It provides a first valve internally disposed within the tube portion 32 and defined in part by the valve plate 90, the lock bolt 109 and the grommet 84. This valve is disposed at the upstream side of the tube portion 32. The seal between the valve plate 90 and the grommet 84 is produced by initially rotating the driving arm 118 manually in a clockwise direction to produce a corresponding rotation of the valve lock bolt 109 and thereafter rotating the driving arm manually in the clockwise direction to produce a pivotal movement of the lock bolt 109 relative to the driving arm 118.

As the lock bolt 109 pivots relative to the driving arm 118, it advances to the left in FIGS. 3 and 4 to become locked in the catch 112 between the rods 114 and 116. The advance of the lock bolt 109 into the catch 112 between the rods 114 and 116 is facilitated by the constraint produced in the bias spring 122 as the lock bolt is pivoted from one side of a straight line defined by the lock bolt and the driving arm 118 to a position on the other side of the straight line.

The initial rotation of the lock bolt 109 and the plate 90 in the clockwise direction causes the plate 90 to become rotated to a position close to the sealing relationship with the grommet 84. The subsequent pivotal movement of the lock bolt 109 in the clockwise direction, and accordingly the advance of the lock bolt 109 to the left in FIGS. 3 and 4, causes an increased force to be imparted to the lock bolt to produce a movement of the left end of the lock bolt into the catch 112 between the rods 114 and 116. This increased force facilitates the sealing of the valve defined by the plate 90 and the grommet 84 even when this sealing is impeded by ice on various parts of the valve including the lock bolt and the detent arrangement defined by the catch 112, the rods 114 and 116 and the left end of the lock bolt. The movement of the lock bolt 109 into sealing relationship with the catch 112 is facilitated by the constraint produced in the bias spring 122 during such pivotal movement of the lock bolt. It is also facilitated by the constraint produced in the spring 136 disposed on the shaft 128.

The valve defined by the tube 32, the gasket 50 and the end cap 34 is disposed externally of the tube downstream in the tube from the valve defined by the tube 32, the end plate 90 and the grommet 84. This provides a safety arrangement for assuring that the tube 32 will be closed against the flow of waste material from the waste storage tank 16. The valve defined by the tube 32, the end cap 34 and the gasket 50 is constructed to provide a positive opening and closure of the tube 32 even when there is ice on various parts of such valve including the tube, the end cap and the gasket.

The positive operation in opening and closing the valve is provided by including the handle lever 64, the latch pin 42 externally of the tube 32 and the latch defined by the can ramp 74, the ramp peak 76 and the hinge-retaining hook 78 at the end of the handle lever 64 opposite the end which is manually rotated. This positive operation is also facilitated by attaching the handle lever 64 to the endcap 34 at one end for pivotal movement relative to the hinge pin 63 on the endcap 34. The positive operation is also facilitated by attaching the end cap 34 to the hinge pin, the hinge pin being attached to the bracket 36 extending from the tube 32.

By pivoting the handle, lever 64 and latching the handle lever to the tube 32 at one end and pivoting the end cap at the other end in accordance with the pivotal and latching movements of the handle lever, a positive action is produced for sealing the end cap and the grommet 50 relative to the outer surface of the tube 32 even when this sealing is impeded by ice on various parts. This arrangement also facilitates the opening of the valve even when ice is formed on various parts in the valve.

As previously described, if the valve defined by the valve plate 90, the lock bolt 109 and the grommet 84 is inadvertently open at the time that it is desired for the valve to be closed, this valve may become closed simultaneously with the closing of the valve defined by the tube 32, the end cap 34 and the gasket 50. This results from the inclusion of the projection or cone 47 on the end cap 34 at the surface of the end cap facing the upstream direction of the tube 32. This projection or cone 47 engages the lock bolt 109, during the rotation of the end cap 34 in the direction to provide a seal with the gasket 50, to rotate and then pivot the lock bolt, and rotate the end plate 90, into a sealing relationship between the end plate and the gasket 50. This sealing relationship is facilitated by the mechanical advantage imparted to the projection or cone 47 to move the lock bolt 109 and the plate 90 in accordance with the rotational movement produced in the end cap 34.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. A valve assembly for use with an aircraft toilet storage tank for facilitating the flushing of waste material from the storage tank under all weather conditions including freezing conditions, including:

a tube defining a fluid passage and having input and output tube openings at opposite ends thereof;

an inner valve movably disposed in the fluid passage and having a closed position preventing communication between the input and output tube openings and having an open position providing for communication between the input and output tube openings, the inner valve having first and second members in said fluid passage initially movable with each other from the open position toward the closed position and then movable relative to teach other to allow movement of the inner valve to the closed position, external layer means operative upon the first member for moving the inner valve between the open position and the closed position a resilient catch included in the inner valve for locking the inner valve in the closed position;

an end cap having a first position providing for a disposition of the inner valve in the open position and a second position providing for a disposition of the inner valve in the closed position, the endcap being constructed to engage the first member to move the inner valve from the open position to the closed position;

second external lever means for moving the endcap between the first position and the second position, the end cap including means for engaging the resilient catch in the second position of the endcap to lock the inner valve in the closed position, the resilient catch for locking the inner valve in he closed position including a spring-biased bolt head.

2. The valve assembly of claim 1 wherein projection means facing into the tube are included in the endcap for engaging the inner valve to move the inner valve to the closed position.

3. The valve assembly of claim 1 wherein the tube has an external flange and the endcap is hingedly coupled to the external flange.

4. The valve assembly of claim 1 wherein the tube has an external mounting flange and the endcap is hingedly coupled at one end to the external mounting flange and is hooked to the second side of the flange.

5. The valve assembly of claim 1 wherein the inner valve includes a rotatable valve plate.

6. The valve assembly of claim 1 wherein cam means are provided in the endcap for applying a multiplied force to the second member to close the resilient catch and wherein the the second lever means pivots the endcap and wherein the cam means applies a multiplied force to the second member to close the resilient catch.

7. Apparatus for use with an aircraft toilet storage tank to facilitate the flushing of waste material form the toilet storage tank under all weather conditions including freezing conditions, including:

a tube, first means supported by the tube at a position within the tube and movable between first and second positions and cooperative with the tube in the first position for sealing the tube against the passage of the waste material through the tube and providing for the passage of the waste material through the tube in the second position, second means supported by the tube at a position exterior to the tube and movable between first and second positions and cooperative with the first means in the first position for sealing the tube against the passage of the waste material through the tube and disposed in the second position to provide for the passage of the waste material through the tube, a fulcrum on the tube, a movable plate providing for sealing the tube and further including a member having a first portion and a second portion, said plate and member being pivotable on the fulcrum and movable with the first means between the first and second positions, the second portion of the member being initially movable with the first portion of the member from the open position of the first means toward the closed position of the first means and being subsequently pivotable relative to the first portion of the member, upon the application of a force to the second portion of the member after the initial movements of the first and second portions of the member, to move the plate into sealing relationship with the tube, and means disposed on the second means for providing a positive force on the second portion of the member during the pivotable movement of the second means between the second and first positions to move the second portion of the member with the first portion of the member and to subsequently pivot the second portion of the member relative to the first portion of the member to move the plate into sealing relationship with the tube.

8. Apparatus as set forth in claim 7 wherein the first means are supported by the tube upstream from the second means in the direction of the passage of the waste material through the tube.

9. Apparatus as set forth in claim 7 wherein means are disposed in the tube for cooperating with the plate to seal the plate in the tube in the first position of the first means.

10. Apparatus as set forth in claim 7, including, latching means supported by the tube externally of the tube, and camming means disposed on the second means and cooperative with the latching means for camming the second means into sealing relationship with the tube during the movement of the first means to the first position.

11. Apparatus for use with an aircraft toilet storage tank to facilitate the flushing of waste material from the toilet storage tank under all weather conditions including freezing conditions, including:

a hollow tube having first and second displaced ends, an endcap movable between first and second positions and constructed to cover the first displaced end of the tube in the first position and to provide an opening through the tube in the second position, means supported by the tube at the first displaced end of the tube in cooperative relationship with the endcap for providing for a pivotal movement of the endcap between the first position and the second position, a latching member on the first end of the tube, lever means pivotably supported on the endcap for engaging the latching member to cam the endcap into a mating engagement with the first displaced end of the hollow tube, and means disposed on the endcap for producing a seal between the endcap and the tube, valve means disposed within the hollow tube intermediate the first and second displaced ends of the tube and movable between first and second positions and operative in the first position to provide a seal with the hollow tube to close the opening in the hollow tube and operative in the second position to provide for a flow of the waste material through the hollow tube, means on the endcap for engaging the valve means to move the valve means initially toward the first position during the movement of the endcap to the first position, the valve means including a member pivotable, in a path different from the initial movement of the valve means, during the movement of the valve means between the first position and the second position, the engaging means on the endcap being disposed in cooperative relationship with the member on the valve means to obtain a disposition of the member on the valve means in the first position during the movement of the endcap to the first position.

12. Apparatus as set forth in claim 11, including, the engaging means being disposed between the endcap and the member on the valve means to provide a progressively concentrated force on the member on the valve means with progressive displacements of the endcap to the the first position.

13. Apparatus for use with an aircraft toilet storage tank to facilitate the flushing of waste material from the toilet storage tank under all weather conditions including freezing conditions, including a hollow tube, a movable plate disposed within the hollow tube for pivotal movement between first and second positions, first means coupled to the plate and disposed within the hollow tube for pivotal movement, a member coupled to the first means for pivotal movement with the first means and for pivotal movement relative to the first means after the pivotal movement of the member with the first means, the member being disposed within the hollow tube and by being coupled to the plate by the first means will allow moving the plate between the first and second positions in accordance with the pivotal movement of the member with the first means to provide for a closure of the tube by the plate in the first position of the plate and an opening of the tube in the second position of the plate, lever means providing the coupling between the first means and the plate for initially producing the pivotal movement of the first means with the member during the movement of the plate from the second position toward the first position and for subsequently providing for the pivotal movement of the member relative to the first means during the movement of the plate to the first position, means coupled to the tube for also initially producing the pivotal movement of the member with the first means and for also subsequently producing the pivotal movement of the member relative to the first means, means for sealing the plate to the tube upon the pivotable movement of the member with the first means and the subsequent pivotal movement of the member relative to the first means, first locking means disposed within the tube, and second locking means disposed on the member for mating relationship with the first locking means in the first position of the plate for retaining the plate in the first position.

14. Apparatus as set forth in claim 13, including, the member being pivotable relative to the fist means from a disposition on one side of an in-line relationship between the first means and the plate pivot to a position on the other side of the in-line relationship to produce a seal between the plate and the tube in the first position of the plate, and spring means disposed on the member to facilitate the movement of the member and the plate to the first position.

15. Apparatus as set forth in claim 14, including, the spring means constituting first spring means, and second spring means disposed on the member adjacent he second locking means for facilitating the movement of the second locking means into mating relationship with the first locking means upon the operation of the lever means to pivot the member with the plate toward the first position of the plate and to pivot the member relative to the first means and for facilitating the movement of the second locking means for mating relationship with the first locking means upon the movement of the plate to the first position.

16. Apparatus for use with an aircraft toilet storage tank to facilitate the flushing of waste material from the toilet storage tank under all weather conditions including freezing conditions, including, a hollow tube, first means disposed in the tube and manually operable between first and second positions and cooperative in the first position with the hollow tube to seal the tube against the flow of waste material through the tube and operative in the second position to provide for a flow of the waste material through the tube, and second means disposed externally of the tube and manually operable between first and second positions and cooperative in the first position with the hollow tube to seal the tube against the flow of waste material through the tube and operative in the second position to provide for a flow of the waste material through the tube, the first means including first and second members initially pivotable in a coordinated relationship in first path for displacing the first means from the second position toward the first position and then pivotable relative to each other, a second path different from the first path of pivotable movement of the first and second members, for producing a seal between the first means and the tube, and third means associated with the second member for facilitating the pivotable movement of the first member relative to the second member into the sealing relationship between the first means and the tube.

17. Apparatus as set forth in claim 16 wherein fourth means are included in the second means in cooperative relationship with the first means for moving the first means from the second position to the first position and into the sealing relationship with the tube when the second means moves from the second position to the first position.

18. Apparatus as set forth in claim 16, including, energy storage means associated with the second member for facilitating the pivotable movement of the first means into the sealed relationship with the tube when the second member is pivoted relative to the first member after the first and second members have been pivoted from the second position toward the first position.

19. Apparatus as set forth in claim 18, including, first sealing means within the tube, second sealing means included in the first means for cooperating with the first sealing means in maintaining the sealed relationship between the first means and the tube in the first position of the first means, retaining means disposed externally of the tube, and latching means included in the second means for cooperating with the retaining means in maintaining the sealed relationship between the second means and the tube in the first position of the second means.

20. Apparatus as set forth in claim 18, including, a shaft disposed within the second member and movable relative to the second member, means disposed between the shaft and the second member for biasing the shaft for displacement from the second member, first sealing means within the tube, and second sealing means disposed at the end of the shaft for cooperating with the first sealing means in maintaining the sealed relationship between the first means and the tube in the first position of the first means.

* * * * *